United States Patent [19]

Valsvik

[11] 4,219,101

[45] Aug. 26, 1980

[54] ACOUSTIC SPACE DIVIDER

[75] Inventor: Donald J. Valsvik, Stillwater, Minn.

[73] Assignee: Conwed Corporation, St. Paul, Minn.

[21] Appl. No.: 914,958

[22] Filed: Jun. 12, 1978

[51] Int. Cl.[2] ..... E04B 1/82

[52] U.S. Cl. ..... 181/286; 181/287; 181/290

[58] Field of Search ..... 181/210, 284–287, 181/290, 294, 295, 30; 256/13.1, 23–27, 45, 73; 160/135, 351; 52/144, 145, 238, 239; 179/1 E

[56] References Cited

U.S. PATENT DOCUMENTS

| | | | |
|---|---|---|---|
| 3,404,498 | 10/1968 | Espinoza | 181/295 |
| 4,050,538 | 9/1977 | Desenfant | 181/210 |
| 4,052,564 | 10/1977 | Propst et al. | 179/1 E |

OTHER PUBLICATIONS

ASTM Standardization News, vol. 4, No. 8, pp. 8–16, "Acoustic Environment in the Open-Plan office".

*Primary Examiner*—L. T. Hix
*Assistant Examiner*—Benjamin R. Fuller
*Attorney, Agent, or Firm*—Eyre, Mann, Lucas & Just

[57] ABSTRACT

A floor-standing acoustic space divider has an upward and outward protuberance along the top edge of at least one of its sides. The protuberance increases the acoustic shadow of the space divider, reflects direct sound back into the area from which it originates, improves speech privacy in open plan architectural space and improves noise reduction in its immediate locale.

7 Claims, 7 Drawing Figures

ACOUSTIC SPACE DIVIDER

BACKGROUND OF THE INVENTION

In recent years the concept of open plan architectural space has become increasingly popular in office buildings. The popularity of this scheme can be attributed to both the advances in acoustical technology and management's desire to have complete flexibility of floor space as business objectives change.

The open office is distinguished by full standing space dividers and easily moved work station enclosures which extend only part way to the ceiling and may be rearranged by office maintenance crews. The dividers and work stations define space and act as visual and acoustic barriers. Some variations thereof support office work surfaces and cabinetry. The theory of acoustic screens is treated in detail in U.S. Pat. Nos. 2,177,393; 2,085,436; 2,116,270; and 4,057,123 all of which are incorporated herein by reference.

BRIEF SUMMARY OF THE INVENTION

One of the principal functions of the screens or space dividers used in open plan space is to attenuate sound between occuppied work zones. Obviously, this could be best accomplished by making the screens extend all the way from the ceiling to the floor. However, this makes each individual partitioned room seem considerably smaller and, in addition, interferes with change when it is desired to increase or decrease the size of a particular work space or rearrange a full floor space. Individual partitioned rooms also require individual lighting and HVAC (heating, ventilating, air conditioning) control.

Because of the desire for visible openness of the entire scheme which makes each work space seem larger than it is, there is a desire to make the screens or space dividers as low as possible. This, of course, has the disadvantage that it will result in increased sound travelling between adjacent work zones. There is thus a requirement for balancing of the height necessary to achieve good sound attenuation versus maintaining the space divider low enough to have good sound attenuation, and the balancing of these two factors has been found to be a difficult problem at best.

In accordance with the present invention, the effective height of the screen or space divider for sound attenuation purposes is considerably increased while the actual height remains the same. This has the dual advantage of increasing sound attenuation without interferring with the visual openness which would be encountered if the actual height of the space divider were increased. This is accomplished by putting an angled projection on the top of the separating divider or screen.

The space divider according to the present invention is preferably made in a Y shape with one angled projection on the top of each side thereof. This has the additional advantage of providing a utility cavity at the top of the screen. This cavity can be used to further directly attenuate sound. Or additional attenuation in sound may be made indirectly by including background noise generators in the cavity. The cavity may be used to house lighting as is explained more fully hereinafter.

DETAILED DESCRIPTION OF THE PREFERRED EMBODIMENT

Figure 1:
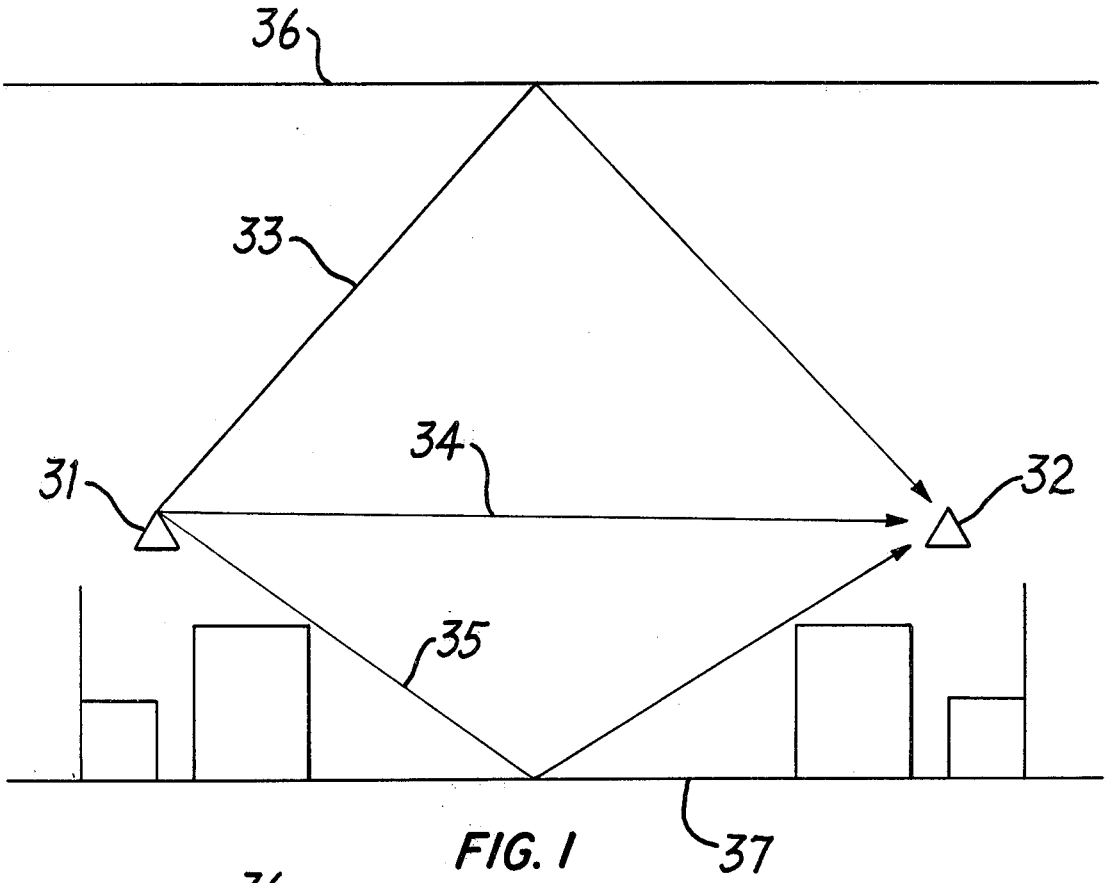
FIG. 1 shows a schematic diagram of sound pathways.

Referring to FIG. 1, sounds originating at source 31 may travel to sound receiver 32 along direct path 34. In addition, sound may follow reflected path 33 off ceiling surface 36 and path 35 off floor surface 37. Note that, as with light waves, the angle of incidence equals the angle of reflection for sound waves. This characteristic of sound bounding off flat surfaces is commonly referred to as specular reflection.

Figure 2:
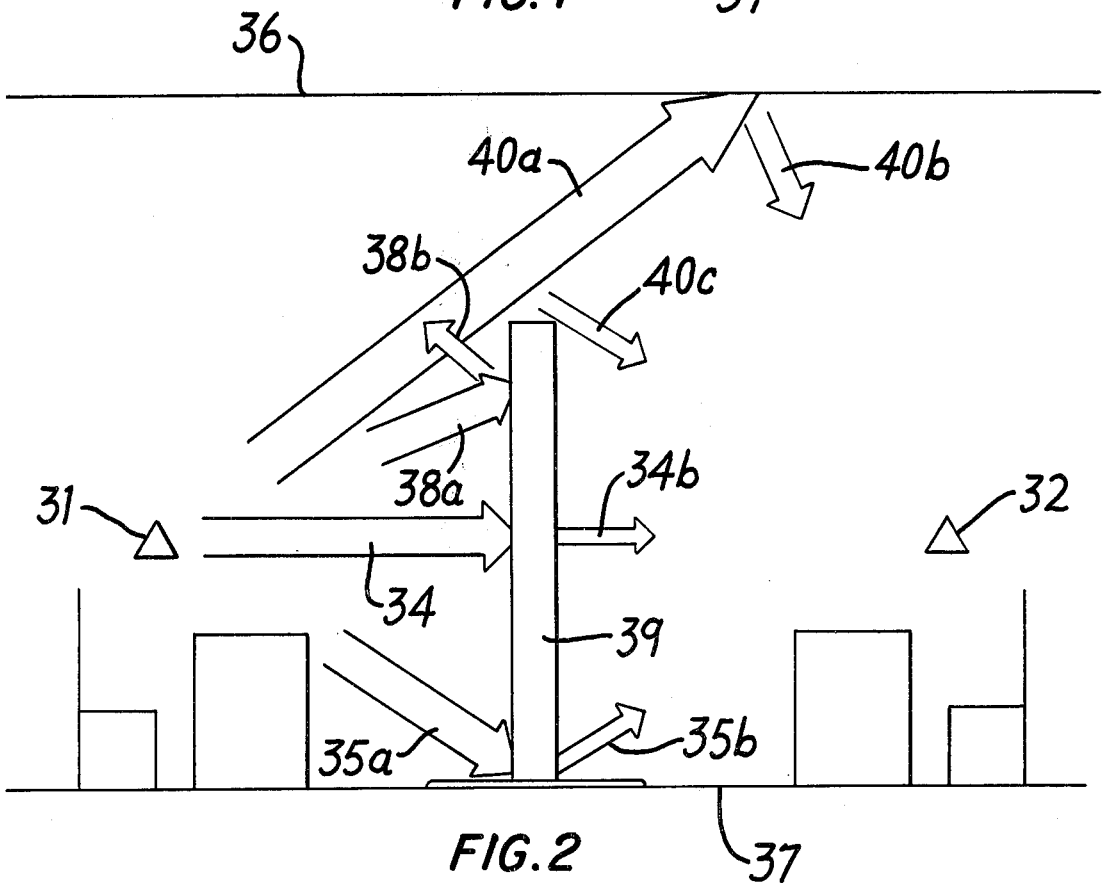
FIG. 2 PRIOR ART
FIG. 2 shows a schematic diagram of sound pathways employing an acoustic screen of the prior art.

Turning now to FIG. 2, a partial-height acoustic screen 39 according to the prior art is located between sound source 31 and sound receiver 32. Sound travelling along direct path 34 strikes screen 39 and is partially absorbed. Some sound, attenuated by the screen 39, passes through the screen 39 along path **34*b* to sound receiver 32. Of greater concern is the upward directed sound path 40*a* which passes the top of the screen 39 and is reflected from the ceiling 36 to the receiver 32. If the ceiling 36 is of acoustically absorbent material, the ceiling reflected sound path 40*b* may be significantly attenuated from the upward directed sound path 40*a*** but there can still be a considerable amount of direct sound and diffracted sound passing from one side of the screen to the other.

In addition to direct and reflected pathways, the sound can pass from transmitter 31 to receiver 32 by bending around the edges of the screen 39 by diffraction. A diffracted sound path **40*c* is shown above the top of the screen 39. Where the screen 39 is an excellent sound absorber and the floor and ceiling treatments are highly acoustically absorbent, the sound diffracted along path 40*c* may become a major contributor in the transmission of direct sound from the transmittor 31 to the receiver 32. The intensity of the diffracted sound decreases as the angle through which the sound must be diffracted increases. It consequently follows that the higher the screen 39 or the closer it is located to the transmitter 31 or the receiver 32**, the more effective the screen is in attenuating diffracted sound. Unfortunately, as previously pointed out, the desired openness and flexibility of the open plan office environment is contrary to the desire for high screens.

Figure 3:
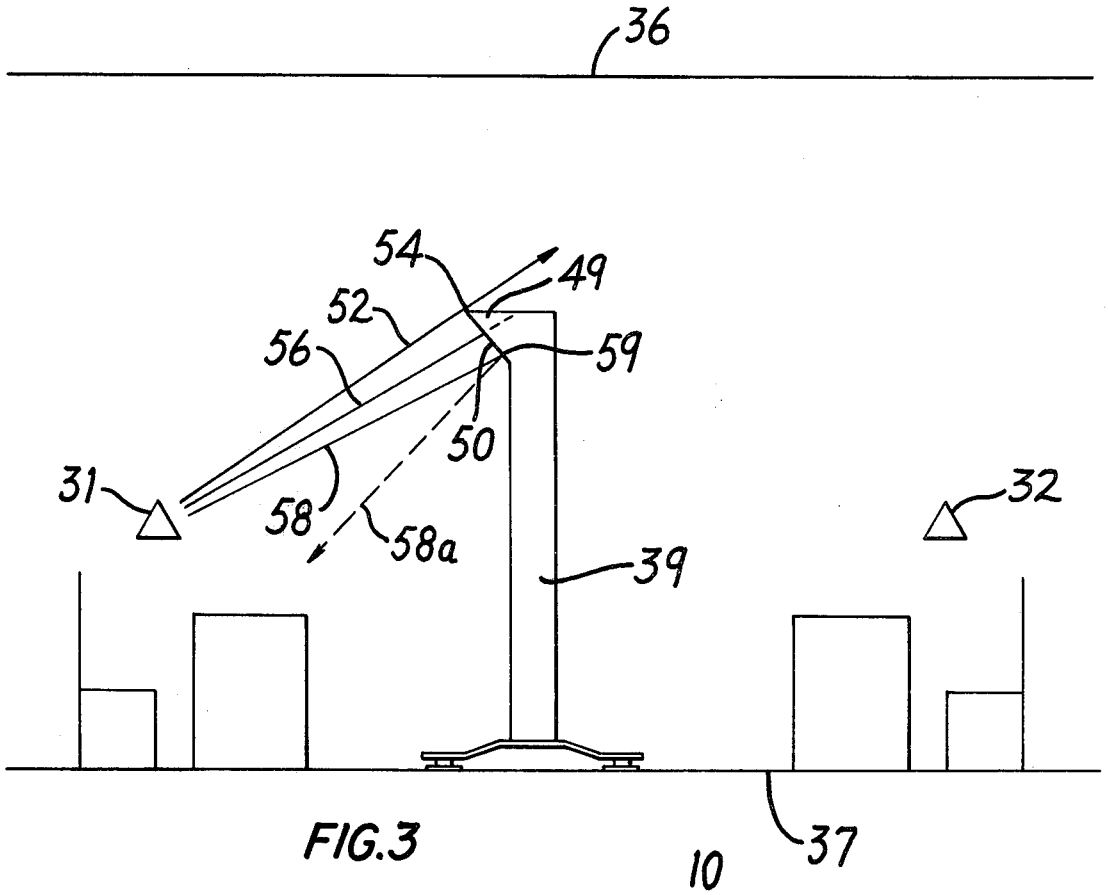
FIG. 3 shows a schematic diagram of sound pathways employing the acoustic screen of the present invention.

Referring now to FIG. 3, there is shown a first embodiment of the invention. In accordance with the present invention, screen 39 is provided with an angled projection 49 at its upper end. The angled projection extends toward the transmitter 31 and is constructed of sound-absorbing material, for example that disclosed in the referenced prior art. The face 50 of the angled projection 49 may be at an angle of from between about 30 degrees to about 60 degrees from the vertical but is preferably from about 40 to about 50 degrees from the vertical. A sound along path 52, which just misses the lip 54 of the projection 49, makes a significantly higher angle to the horizontal than would sound along path 56 which would just miss the top of the screen if the angled projection 49 were omitted or if the screen were just raised to an equivalent height. One effect of the angled projection 49 is therefore an increase in the elevation angle of the sound path which just misses the screen. This increase in angle also increases the angle through which diffraction must take place in order to reach the receiver. The angled projection 49 according to the present invention consequently has the same effect as a significant increase in height of the screen 39 without giving the closed in feeling which would be caused by an increase in actual height of the screen.

In addition to the effect just described, the angled projection according to the present invention also tends to reduce the amount of acoustical energy which is added to the general room noise. Absorption of sound waves depends to a great degree on the amount of area available to absorb it. Because of the large surface area of the angled projection as compared to a straight addition to the panel to bring the overall height to the same level, there will be greater absorption of sound without increasing the height of the structure.

A still further advantage of the angled projection according to the present invention will have is that any sound reflected off the angled projection will be reflected back into the work area from which it emanates rather than upwardly towards the ceiling from whence it can be reflected to another work area. This is especially true when the face of the angles projection is essentially planar in the vertical direction and, for this reason, the essentially planar face is the preferred embodiment.

The effectiveness that a screen according to the present invention can have is shown by test results which show that it can achieve a Noise Isolation Class Prime rating of 22 when tested in accordance with General Services Administration PBS C.2 test procedures. This value is a single number rating which provides an evaluation of sound attenuation between two areas which are acoustically related by one or more paths of sound. Any NIC' rating above 20 makes possible a reduction in certain space acoustical components without sacrificing what is generally regarded as necessary speech privacy in open plan designs.

Figure 4:
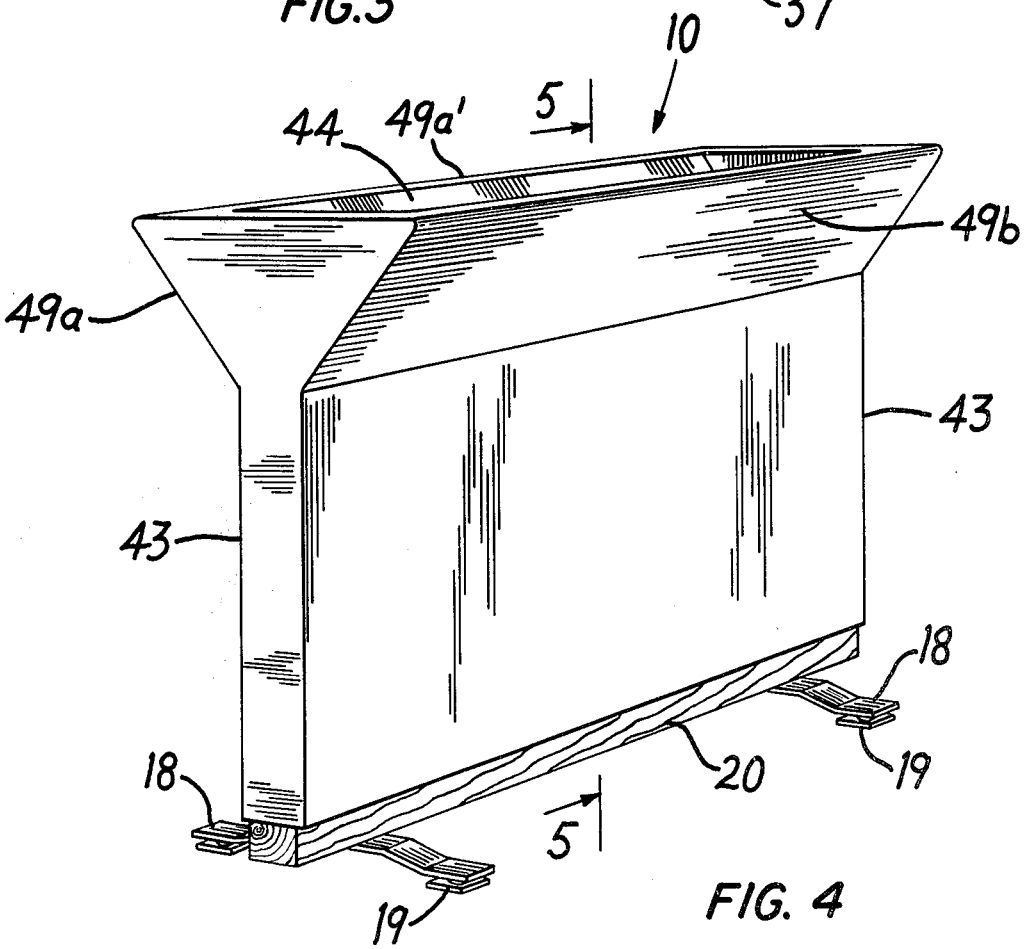
FIG. 4 shows a perspective view of the preferred embodiment of the invention.

Referring now to FIG. 4 there is shown a second and preferred embodiment of the acoustical room divider screen 10 of the present invention. This embodiment uses an angled projection 49*a*, 49*b* on each side of the screen 10. This embodiment is useful where sound may be generated or received on either side of the screen 10.

In addition to attenuating sound which is directed at the front of the angled projection, sound which is reflected off the ceiling or otherwise present will also be attenuated by the rear side of the angled projection, or by the top if the top is a flat structure. This substantially increases the "screen shadow" which the structure of the present invention provides. Screen shadow is a term commonly used in the industry to define the space on one side of a screen which is shielded from any direct sound originating from the other side of the screen. Direct sound as used herein includes sound which travels a direct line between origin and receiver or sound which is not reflected during travel from source to receiver.

A further advantage of this particular construction is that because of the angled projections 49*a*, 49*b*, there will be substantial sound reduction caused by single or double diffraction. More particularly, sound passing near the top 49*a'* of angled projection 49*a* will be diffracted into the cavity which will cause it to lose much of its sound energy. Even sound which is reflected out of the cavity towards angled projection 49*b* will be diffracted as it passes the top of angled projection 49*b* and this will result in further sound attenuation. Since the horizontal distance of the opening of the cavity will have a rather substantial effect upon the amount of sound attenuation, it is preferred that this horizontal distance be as large as practical, suitably at least three times the thickness of the panel itself and preferably at least five times or greater.

A concavity 44 is preferably provided in the upper portion of the screen between the angled projections 49*a*, 49*b*. Lighting, plantings, background noise generators, storage, additional sound absorptive surface, or combinations thereof may be located in or over concavity 44.

In accordance with the preferred embodiments of the present invention, the Y-shaped cavity at the top of the divider or screen is fitted with lighting or background noise generators or both.

As previously explained, the primary problem with sound in open office planning is the transmission of direct sound from one work zone to an adjacent work zone which results in a person hearing one or more distinct, recognizable sounds, albeit one may be of less intensity than the other. One known method for reducing the effect of this direct sound is to use background noise generators. These are typically speakers which emit a sound much like rushing water, blowing air or the like. These background noise generators send out sound waves which tend to mask the sound waves generated by persons talking, copying machines, typewriters or the like so that they are no longer distinct, recognizable sounds but rather become just a part of the general background noise, which is characteristic of the end-use for an open plan space. The applicants have found that it is the direct sound waves transmitted over the tops of the partitions by reflection or diffraction which are most objectionable. Therefore, positioning of background noise generators in the cavity of the Y-shaped dividers according to the preferred embodiment of the invention results in the background noise coming from the same source as the direct sound, i.e. over the top of the partition. The background noise may be either refracted noise or noise reflected off the ceiling at approximately the same place as the directly reflected sound. Since it is coming from apparently the same source, its masking qualities for this direct sound are materially enhanced.

Turning now to a discussion of lighting, one of the more effective sound absorbers in open office planning is the acoustic ceiling. The panels in the acoustic ceiling frequently have noise reduction coefficients as high as 85 or more. If lighting for the room is achieved by the usual lay-in lighting fixtures of 2 foot by 4 foot or 2 foot by 2 foot dimension there is little or no sound absorption in these areas and sound impinging on the lens of the light fixture will be substantially completely reflected.

On the contrary, however, when the lighting is provided by lights which are positioned in the cavity at the top of the Y-shaped preferred embodiment of the present invention, there is no need for additional lighting from the ceiling and the entire ceiling can be made of acoustically absorbent material. This can result in substantially greater sound absorption and substantially reduced reflection of sound in the open plan area. Another benefit of this particular form of construction is that indirect lighting which gives the desired subdued atmosphere to the open office plan can be achieved without the need for separate, and costly, indirect lighting fixtures.

The screen 10 of the present invention may suitably be from about 4 to about 8 feet high but is preferably less than about 6 feet high. The angled projection should have an effective length at least about 5% of the height of the screen but may be as much as 10% or more. The term effective length is used since the angled projection need not be straight and could be curved (concavely or convexly), stepped or the like. The effective length of the angled projection is the straight distance from the top of the vertically extending portion of the screen (i.e. from the bottom edge of the angled projection) to its furthest extending edge (i.e. to the top edge of the angled projection).

The inner construction of the screen of the present invention is not a part of our invention. We prefer, however, to use an acoustical construction such as that shown in U.S. Pat. No. 4,057,123.

Figure 5:
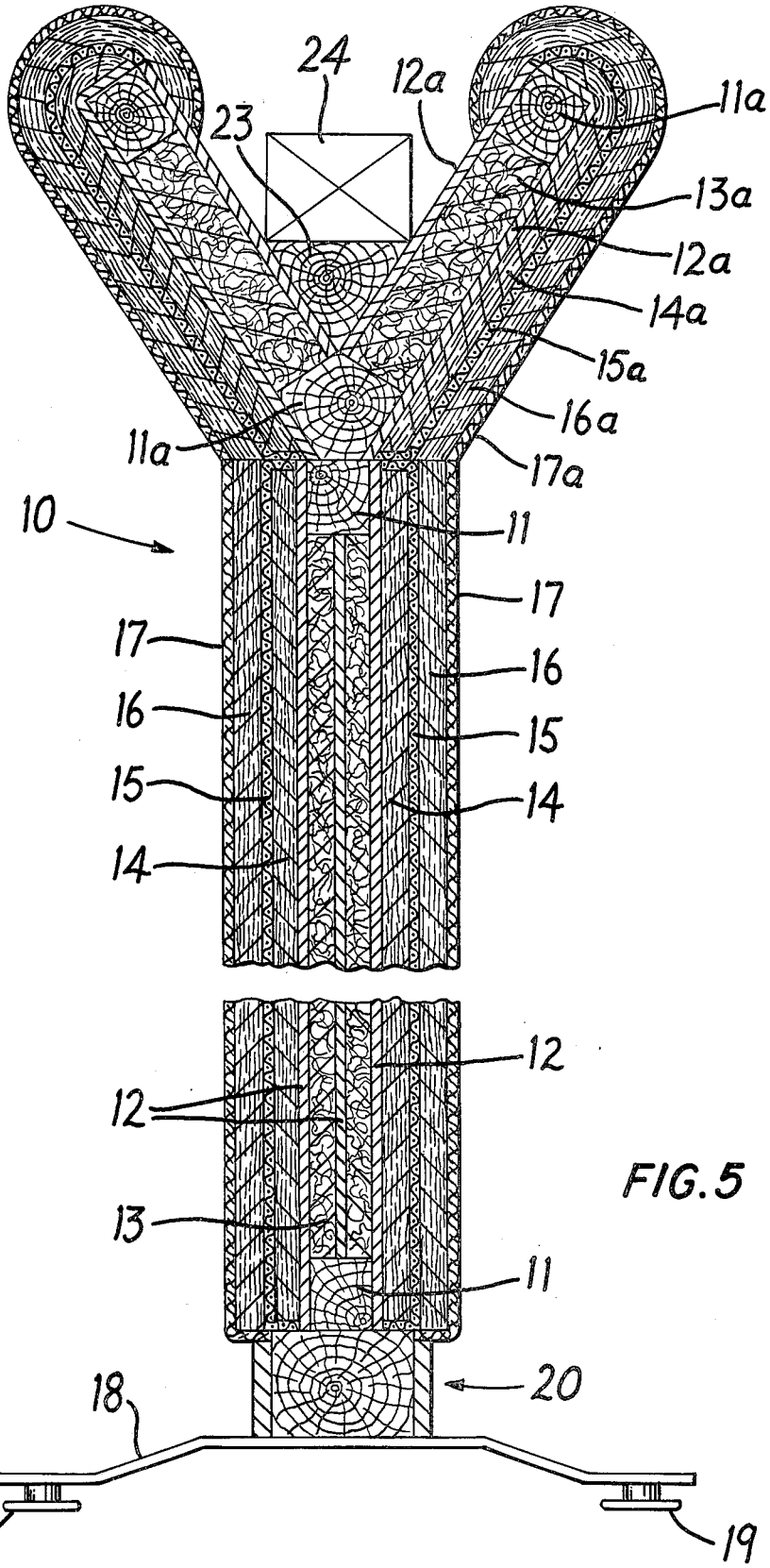
FIG. 5 shows a transverse cross-section of the preferred embodiment of the invention taken along 5—5 of FIG. 4.

In FIG. 5 there is shown a typical cross-sectional construction of the preferred embodiment of the present invention.

Frame members 11 provide support for the screen. It is mounted on a base 20 to which are mounted legs 18 having levelling feet 19 so that the structure can be free standing, which is a preferred embodiment. Affixed to either side of frame members 11 are membranes 12. There is also a membrane 12 running vertically from upper frame member 11 to lower frame member 11, approximately half way between the faces of the frame member.

Membranes 12 hold in place inner layers of sound absorbing material 13. This material may be any substance which is capable of absorbing sound, e.g. mineral wool. A reinforcing layer 15 is stretched over the face of sound absorbing material 14. The reinforcing layer 15 enhances the screen's overall structural stability. Typical materials used for this purpose are plastic netting, perforated foil laminates, or wire mesh. Sound absorbing material 16 is mounted on the face of reinforcing material 15. For lightness, fire rating and good absorbing properties, this material is preferably a glass fiber blanket having a density from about 0.5 pcf to about 3.0 pcf. The blanket cound range in thickness from ¼" to 2".

On the face of sound absorbing material 16 is a decorative fabric covering layer 17. Typical covering materials include burlap, acrylics, polyesters, and the like.

On the upper portion of screen 10 the components are constructed of the same materials but the suffix a has been added to each descriptive number to indicate their locations on the upper portion of the screen. The upper portion of the screen may be manufactured independently of the lower or vertical portion. The upper portion may then be suitably placed on the lower portion and attached by any conventional means such as wood screws through framing member 11*a* into framing member 11. Alternatively the upper and lower portions may be made as a unit.

Screens built according to the teachings of the present invention employing different internal construction are also within the spirit of the present invention.

The upper portion of the screen includes a support member 23. This support member holds concavity apparatus 24. As noted earlier, concavity apparatus 24 is preferably lighting means or a background noise generator or both.

Figure 6:
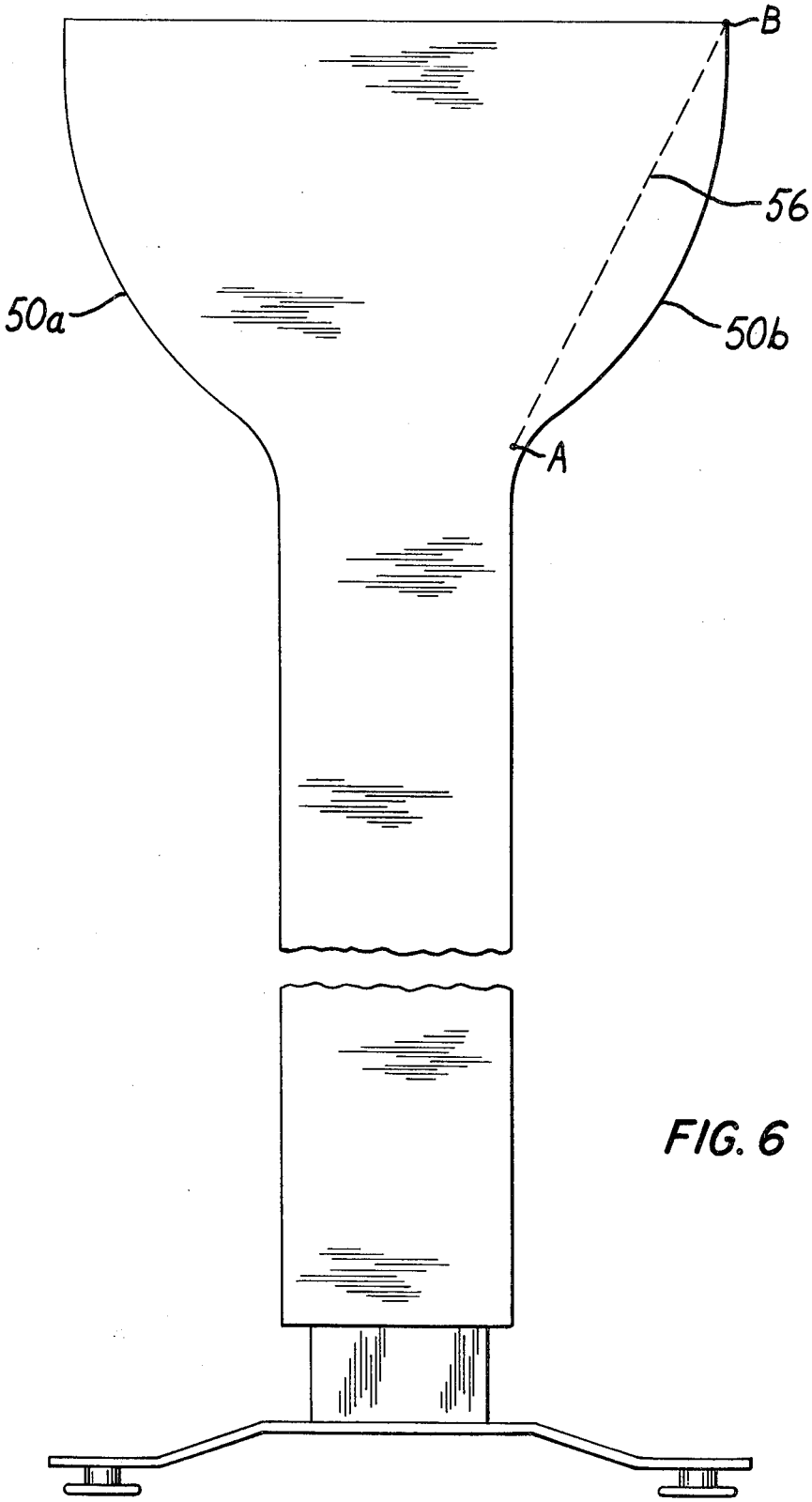
FIG. 6 shows an end cross-sectional view of a second embodiment of the invention.
Figure 7:
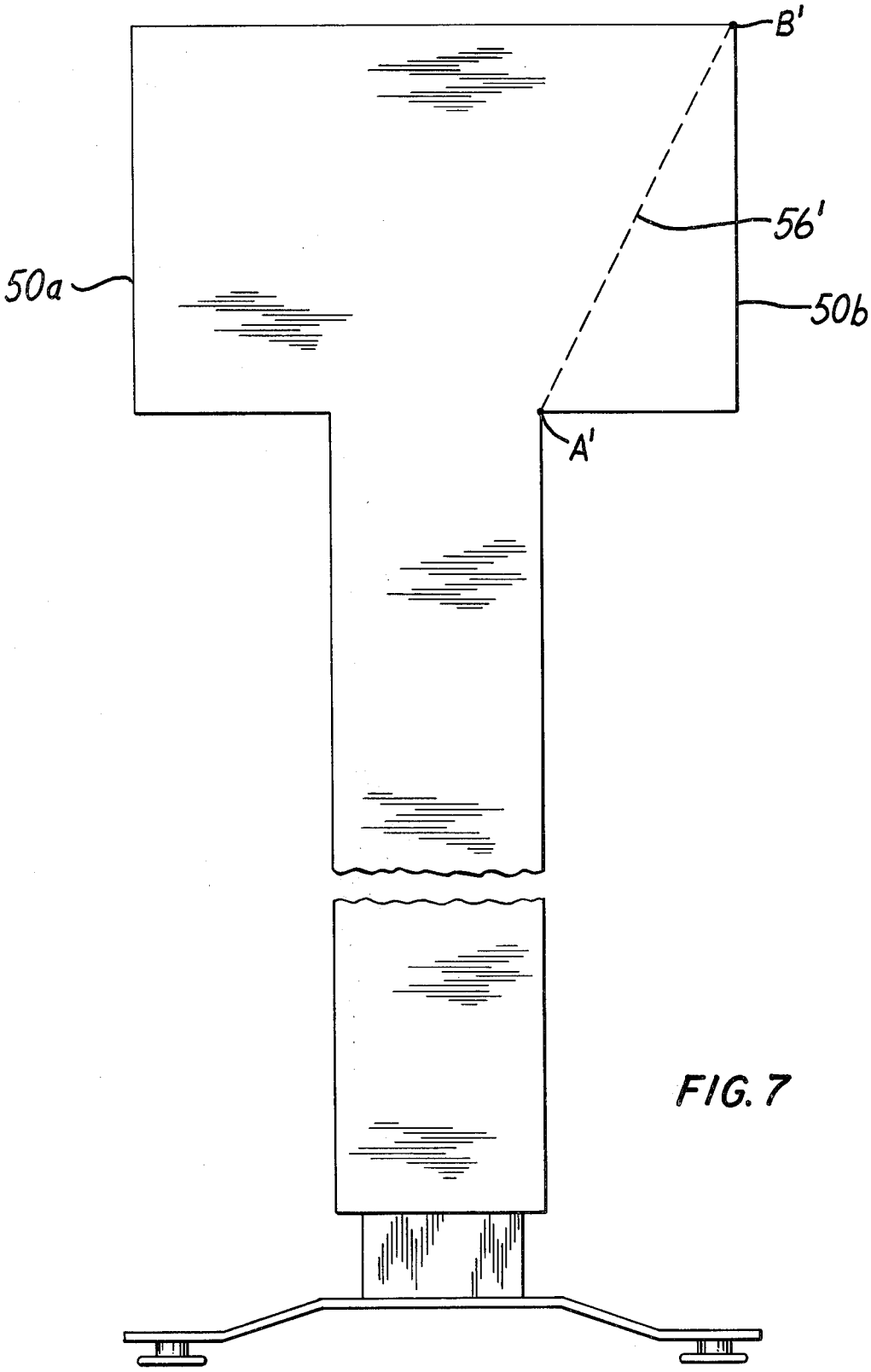
FIG. 7 shows an end cross-sectional view of a third embodiment of the invention.

As shown in FIGS. 6 and 7 and as discussed hereinbefore, the angled projections 49*a*, 49*b* need not have planar faces 50*a*, 50*b*. Instead, the faces 50*a*, 50*b* may be rounded as shown in FIG. 6 or stepped as shown in FIG. 7. This enables the addition of significantly more sound absorbing material in the projections 49*a*, 49*b* than would be conveniently possible if the faces 50*a*, 50*b* were made flat. In FIG. 6 the effective length of the angled projection is from point A to point B on dashed line 56 and in FIG. 7 the effective length of the angled projection is from point $A^1$ to point $B^1$ on dashed line $56^1$. In each case, the effective angle of the projection is measured along the same line.

It will be understood that the claims are intended to cover all changes and modifications of the preferred embodiments of the invention, herein chosen for the purpose of illustration, which do not constitute departures from the spirit and scope of the invention.

What is claimed is:

1. A free-standing sound-absorbing structure comprising:

a. A substantially vertical acoustic screen panel; said acoustic screen comprising a frame, a decorative fabric covering layer on each face thereof and sound absorbent material in the interior thereof;

b. said panel section being from about 4 to about 6 feet in height;

c. said panel section being substantially rectangular and having a base along the lower longitudinal edges thereof;

d. legs affixed to said base effective to provide a free-standing support for said panel section;

e. two angled projections, each one being along substantially the entire length of the opposed upper longitudinal edges of said panel section whereby each said angled projection is disposed horizontally when the sound absorbing structure is in the free-standing position; and f. each said projection being acoustic and being inclined upward and outward from its longitudinal edge of the panel section at an effective angle from about 30 to about 60 degrees from the vertical and for an effective length of at least about 5% of the height of the vertical panel section.

2. The structure recited in claim 1 wherein said panel has an NIC' rating of at least 22 when tested in accordance with GSA PBS C.2 test procedures.

3. The structure recited in claim 1 wherein the concavity apparatus comprises lighting means.

4. The structure recited in claim 1 wherein the concavity apparatus comprises background noise generation means.

5. The apparatus recited in claim 1 wherein the faces of said one and said second angled projections are substantially planar.

6. A free-standing sound-absorbing structure comprising:

(a) a substantially vertical acoustic screen panel section said acoustic screen comprising a frame, a decorative fabric covering layer on at least one face thereof and sound absorbent material in the interior thereof;

(b) said panel section being from about 4 to 8 feet in height;

(c) said panel section having means which support it in a free-standing position;

at least one angled projection along substantially the entire length of one upper longitudinal edge of said panel section whereby said angled projection is disposed horizontally when the sound absorbing structure is in the free-standing position; and (d) said projection being acoustic and being inclined upward and outward from the said upper longitudinal edge of said panel section at an effective angle of from about 30 to about 60 degrees from the vertical length of at least about 5% of the height of the vertical panel section.

7. A free-standing sound absorbing structure comprising:

(a) a substantially vertical acoustic screen panel section said acoustic screen comprising a decorative fabric covering layer on each face thereof and sound absorbent material in the interior thereof;

(b) said panel section being from about 4 to about 6 feet in height;

(c) said panel section being substantially rectangular and having a base along the lower longitudinal edge thereof;

(d) legs affixed to said base to provide free-standing support of said panel section;

(e) two angled projections, each one being substantially the entire length of the opposed upper longitudinal edges of said panel section whereby each said angled projection is disposed horizontally when the sound-absorbing structure is in the free-standing position;

(f) each said projection being acoustic and being inclined upward and outward from its longitudinal edge of the panel section at an effective angle of from about 40 to about 50 degrees from the vertical and for an effective length of at least about 10% of the height of the vertical panel section;

(h) a cavity along the top of said panel defined by two said projections;

(i) said cavity having a width at the top thereof of at least three times the thickness of said panel whereby substantial sound reduction is obtained through diffraction of sound passing over the angled projections;

(j) concavity apparatus in said cavity, said concavity apparatus being concealed from normal, direct view by said angled projections.

* * * * *